United States Patent [19]

Chestnov et al.

[11] 4,128,925

[45] Dec. 12, 1978

[54] ARRANGEMENT FOR ASSEMBLING VACUUM TUBE BASES

[76] Inventors: Valery F. Chestnov, ulitsa Vasenko, 15, kv. 18; Mikhail V. Shibanov, ulitsa Michurina, 26, kv. 3, both of Saransk Mordovskoi ASSR, U.S.S.R.

[21] Appl. No.: 832,429

[22] Filed: Sep. 8, 1977

Related U.S. Application Data

[63] Continuation of Ser. No. 559,871, Mar. 19, 1975, abandoned.

[51] Int. Cl.[2] ..... H01J 9/06; H01J 9/48

[52] U.S. Cl. ..... 29/25.2

[58] Field of Search ..... 29/25.19, 25.2; 316/27, 316/30, 31

[56] References Cited

U.S. PATENT DOCUMENTS 3,728,005 4/1973 Alexandrov et al. ..... 316/31

*Primary Examiner*—Richard B. Lazarus

*Attorney, Agent, or Firm*—Haseltine, Lake & Waters

[57] ABSTRACT

An arrangement for assembling bases of vacuum tubes, e.g. fluorescent tubes, comprises continuously rotating rotors made in the form of sprockets which are engaged by an endless chain conveyor. The conveyor is intended for both actuating the sprockets and transporting bases. Attached to the conveyor links in a cantilevered manner are clamps carrying vacuum tube bases and adapted to move across a conveyor link thus entering the zone of action of actuating mechanisms provided for each sprocket. The herein disclosed arrangement is simple, compact and highly efficient.

6 Claims, 18 Drawing Figures

ARRANGEMENT FOR ASSEMBLING VACUUM TUBE BASES

This is a continuation of application Ser. No. 559,871 filed Mar. 19, 1975 and now abandoned.

The present invention relates to vacuum tube manufacturing equipment, and more particularly to arrangements for assembling bases of vacuum tubes, e.g. fluorescent tubes.

Known at present are carrousel-type arrangements for assembling vacuum tube bases. The carrousel in such an arrangement rotates continuously with clamps for transporting bases from one actuating mechanism to another being evenly spaced along the entire circumference thereof. These clamps are adapted to be lowered, under the action of a force applied thereto, to the zone of action of a respective actuating mechanism and returned to the initial position under the action of a spring.

The actuating mechanisms are arranged in the stationary portion of the arrangement and actuated by a cam-and-lever driving means. In these arrangements, the assembling operations are performed when the carrousel is arrested. An assembling operation performed when the carrousel has been brought to a stop normally comprises the following steps: lowering a base into the zone of action of an actuating mechanism, performing a respective operation, and removing the base from the zone of action of the actuating mechanism.

These arrangements, however, have a low efficiency because of the low speed of rotation of the carrousel, which is mainly due to high inertial loads occurring at the beginning and end of each rotation cycle as bases are being transferred from one actuating mechanism to another. These loads eventually result in rapid wear of individual mechanisms of the assembling arrangement. Besides, such arrangements have a relatively complicated structure.

Also known are continuous carrousel-type arrangements for assembling vacuum tube bases, comprising working and transporting rotors. The number of working rotors is determined by that of the assembling operations to be performed, e.g. shaping electrodes, flattening and bending the electrode ends, placing the cathode onto the bent ends, clamping the cathode with the bent ends, oxidizing the cathode.

Each working rotor comprises two carrousels rotatably mounted on a column. One of the carrousels is provided with clamps for holding bases, arranged along its circumference, while the other has actuating mechanisms secured thereto. Formers are fixedly arranged on the working path of the actuating mechanisms and clamps. One of the formers is intended for moving the clamps towards the actuating mechanisms for bases to be introduced into the zone of action of these mechanisms. The other former is designed to actuate the actuating mechanisms.

Each transporting rotor comprises a carrousel with clamps being arranged along its circumference, which clamps are designed to pick up bases for a working rotor and transfer them to another working rotor for a subsequent operation to be performed.

Both the working and transporting rotors rotate in synchronism, being driven by a common drive.

However, these arrangements are unduly complicated and, since the performance of an operation necessitates at least two rotors, too cumbersome. A base being repeatedly transferred from a working rotor to a transporting one, then from the latter to another working rotor, etc, substantially complicates the procedure of assembling a base, which may eventually result in the latter being damaged. In addition, as a base is being transferred from one rotor to another, it is picked up at one point with the result that the orientation of the base may be reversed since picking up takes a very short period of time.

It is an object of the present invention to provide an arrangement for assembling vacuum tube bases with its rotors and base transporting means being improved so as to synchronize the performance of an assembling operation with the simultaneous rotation of the rotors and movement of the base transporting means with a view to substantially enhancing the efficiency of the arrangement and precluding repeated picking up of bases in the course of assembling.

With this and other objects in view, in an arrangement for assembling vacuum tube bases, comprising continuously rotating rotors equal in number to the assembling operations, from the electrode shaping operation to that of cathode oxidizing, and carrying actuating mechanisms actuated by stationary formers to perform respective operations in co-operation with the bases held in clamps which are lowered into the zone of action of the actuating mechanisms, each rotor is, according to the invention, made in the form of a sprocket, all the sprockets being engaged by a common endless chain conveyor intended for both actuating these sprockets and transporting the bases, the clamps being attached to the conveyor links in a cantilevered manner, and the actuating mechanisms being arranged on each sprocket so that the spacing therebetween is equal to the arc between the centres of the clamps with the sprockets being engaged by the chain conveyor.

Arranging the rotors and base transporting means in the above fashion makes it possible to substantially cut down the size of the proposed assembling arrangement as well as precluding repeated picking up of bases as they are being transferred from one operation to another since, in the course of assembling, the bases are permanently held in the clamps or the moving conveyor. Moreover, performing assembling operations in the process of base movement substantially improves the efficiency of the proposed arrangement.

According to another feature of the invention, an additional chain conveyor is provided in proximity to the endless chain conveyor, having a common drive therewith and intended for delivering the assembled bases for further treatment, the additional chain conveyor being provided with clamps for picking up bases and formers being arranged on the working path of the clamps of both chain conveyors, co-operating with the clamps for their successive opening while bases are being picked up.

The additional conveyor enables the orientation of a base to be maintained due to its being transferred from one clamp to another over a substantially long stretch.

According to still another feature of the invention, some of the sprockets serve as driving ones and are kinematically associated with the drive of the arrangement to actuate the chain conveyor. This permits part of the load on the chain conveyor to be relieved as the latter transmits movement to the remaining sprockets, and enables the overall load to be more evenly distributed.

According to yet another feature of the invention, the sprockets are biased with respect to one another with the result that the chain conveyor engaging them forms a zigzag pattern. Such a mutual arrangement of the sprockets and conveyor makes it possible to increase the wrapping angle for each sprocket, whereby the operation of the actuating mechanism is rendered more reliable, as well as to provide for a more compact grouping of the sprockets, thereby cutting down the size of the whole arrangement respectively.

In accordance with one more feature of the invention, each sprocket is made up of two rigidly interlinked toothed discs disposed one below the other so that the spacing therebetween is equal to the width of the chain conveyor to accommodate the conveyor clamps. This permits of eliminating transverse displacement of the chain conveyor as it engages a sprocket and therewith enables the clamps to be introduced into the space between the discs; the clamps being accommodated in the space between the axis of rotation of the sprocket and the chain renders the proposed arrangement highly compact.

According to an additional feature of the invention, through holes are made in the sprocket discs between which are disposed the conveyor clamps, the holes in the top disc accommodating spring-loaded rods each having one of its ends interacting with a former while the other end interacts with a clamp enabling it to be lowered into the zone of action of an actuating mechanism, and the holes in the bottom disc being intended for the passage therethrough of vacuum tube bases as they enter the zone of action of a respective actuating mechanism.

The invention is also characterized in that the sprockets are disposed intermediate or two fixed plates arranged one above the other with the formers interacting with clamps being disposed on the top plate and the formers interacting with actuating mechanism being disposed on the bottom plate. These plates enhance the rigidity of the whole assembling arrangement.

The invention is further characterized in that provided upstream of the sprocket carrying the actuating mechanisms for shaping base electrodes, on the working path of the conveyor clamps, is a former interacting with the clamps so as to open them at the moment when they receive bases from an inclined tray disposed near the conveyor. This feature enables automatic loading of the conveyor clamps with bases.

And, finally, the invention is characterized in that the former interacting with the actuating mechanisms for oxidizing the cathode is in the form of a ring whereof the surface which is in contact with an actuating mechanism has a corrugated and a flat portions, each actuating mechanism for oxidizing the cathode being provided with a vessel for a suspension, accommodating a spatula with a mixer, and a rod with a roller, the rod being associated with the spatula and received in a guide in which the rod travels as the roller rolls over the corrugated portion of the ring to actuate the spatula with the mixer which agitates the suspension and over the flat portion of the ring to withdraw the spatula from the vessel for applying the suspension onto the cathode.

Thus, the proposed arrangement for assembling vacuum tube bases has a simplified and compact structure with the possibility of occurrence of inertial loads eventually leading to rapid wear of its mechanism being completely ruled out; in addition, the proposed arrangement has a throughput capacity far superior when compared to that of similar arrangements currently in use.

The invention will now be described in greater detail with reference to a specific embodiment thereof, taken in conjunction with the accompanying drawings, wherein.

Figure 2:
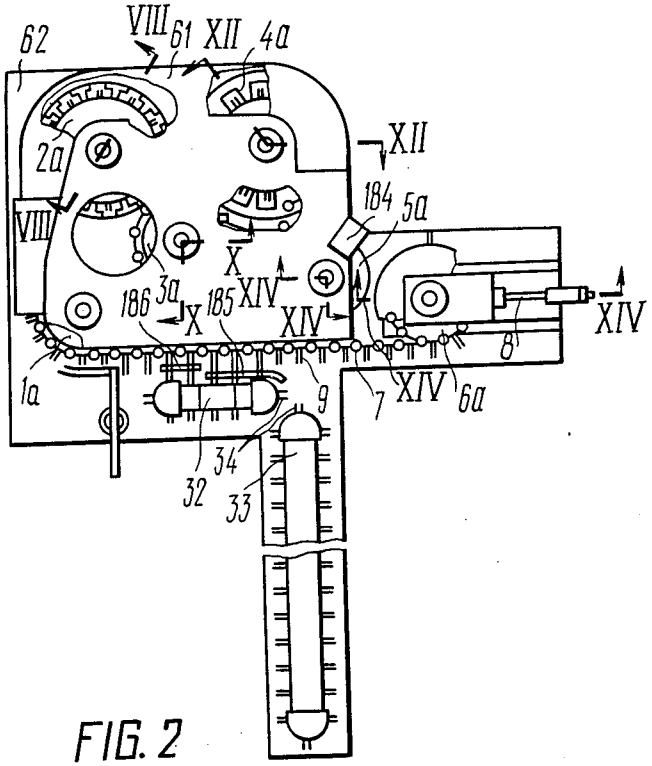
FIG. 2 is a diagrammatic top view of the proposed arrangement.

Referring now to the accompanying drawings, the arrangement for assembling vacuum tube bases comprises the following rotors 1 to 6 (FIGS. 1 and 2) in accordance with the sequence of assembling operations: rotor 1 for loading bases, rotor 2 for shaping base electrodes, rotor 3 for flattening electrode ends, rotor 4 for bending electrode ends, rotor 5 for clamping the cathode with electrode ends, and rotor 6 for oxidizing the cathode.

Each of the rotors 1 to 6 is made as a sprocket (1*a*–6*a*) attached whereto are known per se actuating mechanisms for performing respective assembling operations. All the sprockets 1*a* to 6*a* are engaged by a common endless chain conveyor 7 with a tensioning device 8 (FIG. 2) associated with the sprocket 6*a*. The endless chain conveyor 7 serves as a drive for the sprockets and as a means for transporting bases. Attached to the conveyor links in a cantilevered manner are clamps 9 which are adapted to move across respective links to be lowered into the zone of action of respective actuating mechanisms and to retain a base in a vertical position in the course of the conveyor's movement and in the course of assembly which is simultaneous with the movement of the conveyor.

Figure 1:
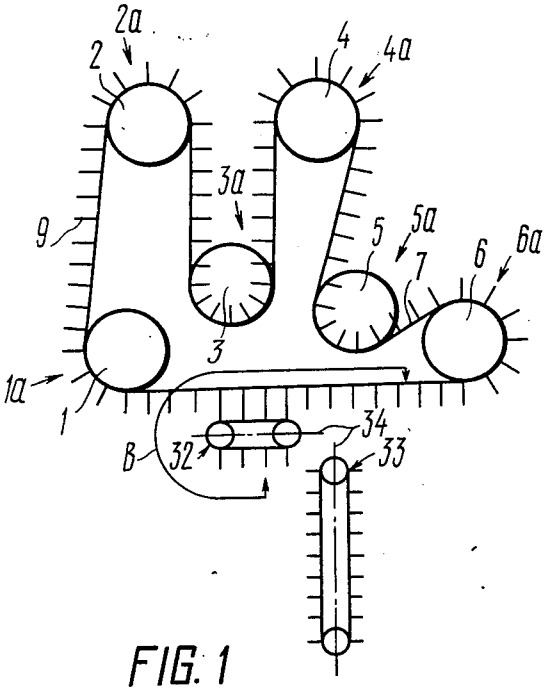
FIG. 1 is a flow diagram illustrating the process of assembling vacuum tube bases on the proposed arrangement, according to the invention.

The sprockets 1a to 6a are biased with respect to one another with the result that the chain conveyor 7 engaging them forms a zigzag pattern, as can be seen from FIG. 1.

Figure 3:
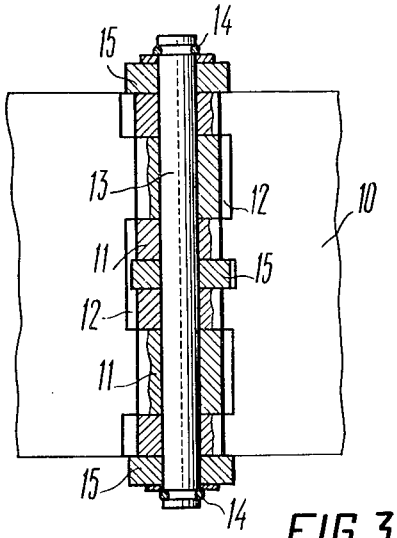
FIG. 3 illustrates a partial longitudinal section of a conveyor chain joint, according to the invention.

Each link of the conveyor 7 is in the form of a plate 10 (FIG. 3) provided with lugs 11 alternating with recesses 12 to receive the mating lugs of the adjacent links. The lugs 11 are received about a link pin 13 joining two links together and retained in the lugs by means of check rings 14. Provided at the ends of the link pin 13 and in the middle thereof are rollers 15 which travel along guides 16 (FIG. 4) in the course of movement of the conveyor 7, precluding thereby lateral displacement of the chain. The guides 16 are mounted on the frame of the arrangement, which is not shown in FIG. 4.

Figure 5:
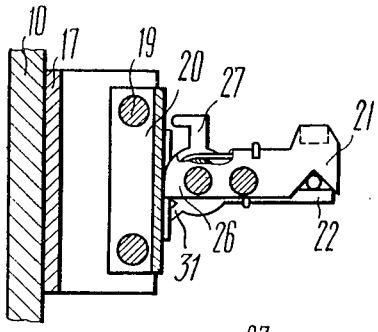
FIG. 5 is a top view of the conveyor clamp of FIG. 4.
Figure 5:
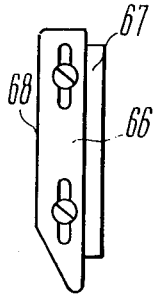

Each clamp 9 includes a cleat 17 screwed at 18 to a respective link and provided with two guides 19 (FIG. 5), as well as a slide 20 disposed on the guides 19 and bearing a rear jaw 21 and a front jaw 22.

The jaws 21 and 22 (FIG. 4) are rotatably mounted on a pivot 23 and are pressed against each other by springs 24 and 25, respectively, to thus retain a base in position. The jaws 21 and 22 (FIG. 5) are provided with stops 26 and 27, respectively, which abut against the slide 20 to preclude overlapping of the jaws. A roller 28 is provided on top of the rear jaw 21, while a roller 29 is provided on the slide 20, the latter being retained in the upper position with the aid of a spring 30. The front jaw 22 is also provided with a stop 31.

Situated in proximity to the conveyor 7 (FIG. 1) is an additional conveyor 32 which is similar to the conveyor 7 and has a common drive therewith. The conveyor 32 is intended to deliver the assembled bases for further treatment, e.g. for preparing the cathode, which is done on a conveyor 33. Attached in a cantilevered manner to the links of the conveyors 32 and 33 are clamps 34 similar to the clamps 9; the clamps 34 as well as 9 are equidistant. The number of the additional conveyors 32 and 33 depends on that of the additional operations to be performed to completely assemble vacuum tube bases.

Figure 6:
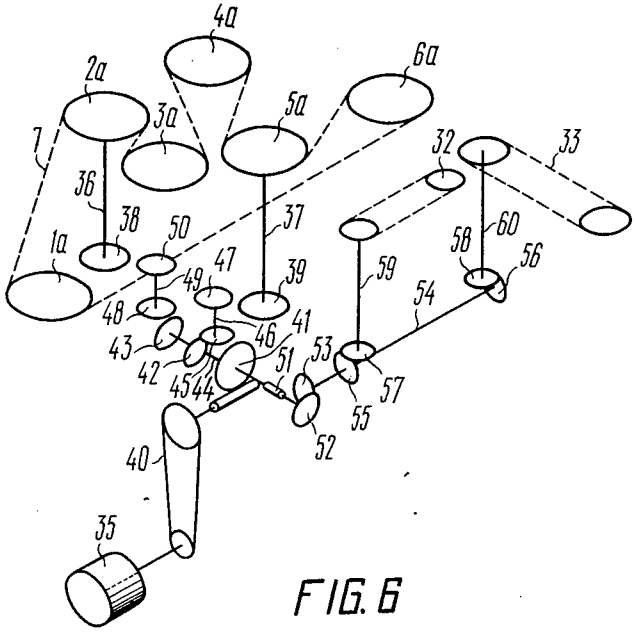
FIG. 6 is a functional diagram of the proposed arrangement.

The chain conveyor 7 (FIG. 6) as well as additional conveyors 32 and 33 have a common drive. They are actuated by at least two driving sprockets 2a and 5a which are kinematically associated with a drive, e.g. an electric motor 35.

The kinematic linkage between the sprockets 2a and 5a and the motor 35 is effected through cylindrical gears 38 and 39 fitted on hollow shafts 36 and 37 of the sprockets 2a and 5a respectively.

Movement is transmitted from the motor 35 with the aid of a V-belt drive 40 and a worm reducer 41 through bevel pinions 42 and 43 fitted on a shaft 44. The pinion 42 interacts with a bevel gear 45 fitted on a common shaft 46 with a cylindrical gear 47 which meshes with the gear 39. The pinion 43 interacts with a bevel gear 48 fitted on a common shaft 49 with a cylindrical gear 50 which meshes with the gear 38. Movement is transmitted to the conveyors 32 and 33 from the reducer 41 through a coupling 51 and a pair of bevel gears 52 and 53. The gear 53 is fitted on a shaft 54 together with bevel pinions 55 and 56 which interact with, respectively, bevel gears 57 and 58. The gear 57 is fitted on a shaft 59 together with the driving sprocket of the conveyor 32, while the gear 58 is fitted on a shaft 60 together with the driving sprocket of the conveyor 33.

Figure 7:
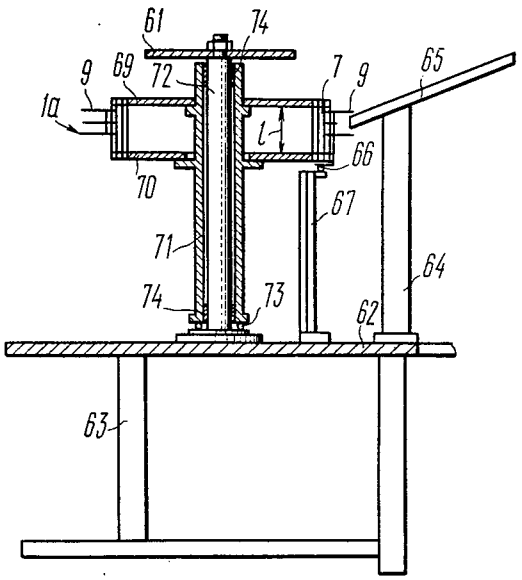
FIG. 7 is a section view taken along line VII—VII of FIG. 2.

The sprockets 1a to 6a (FIG. 2) are arranged intermediate of two plates 61 and 62, the plate 61 being above and the plate 62 (FIG. 7) being below the sprockets; the plate 62 is mounted on a frame 63. Secured to the plate 62 is a vertical prop 64 bearing an inclined tray 65. The lower end of the tray 65 is near a clamp 9 of the conveyor 7 thus making it possible for bases to slip from the tray 65 into the open clamp 9. The clamp 9 is opened to receive a base by means of a former 66 which is disposed on a bracket 67 on the working path of the clamps 9 of the conveyor 7. The former 66 (FIG. 5) is in the form of a plate with the stop 31 of the front jaw 22 sliding over its side surface 68.

The tray 65 (FIG. 7) is installed in proximity to the sprocket 1a engaged by the chain conveyor 7 or near the conveyor 7 itself if the arrangement is not provided with the sprocket 1a which is intended, mainly, to provide for a reserve of clamps 9 loaded with bases.

Each of the sprockets 1a to 6a is made up of two toothed discs 69 and 70 arranged so that the spacing therebetween is equal to the width of the links of the chain conveyor 7, and as the conveyor 7 engages the sprockets 3a and 5a (FIG. 1), its clamps 9 enter the space between the discs occupying, to be more specific, the space between the chain and the axis of rotation of these sprockets. The sprockets being engaged by the chain conveyor 7, the rollers 15 of the link pins of each link thereof enter the recesses between the teeth of the discs 69 and 70 (FIG. 7), thereby setting the sprockets into rotation.

The discs 69 and 70 of the sprocket 1a are secured to lugs on a hollow shaft 71 fitted on a pintle 72 and resting on bearings 73. Provided between the pintle 72 and shaft 71 are bearings 74 which ensure free rotation of the shaft 71 together with the sprocket 1a relative to the pintle 72 secured to the plates 61 and 62.

Figure 8:
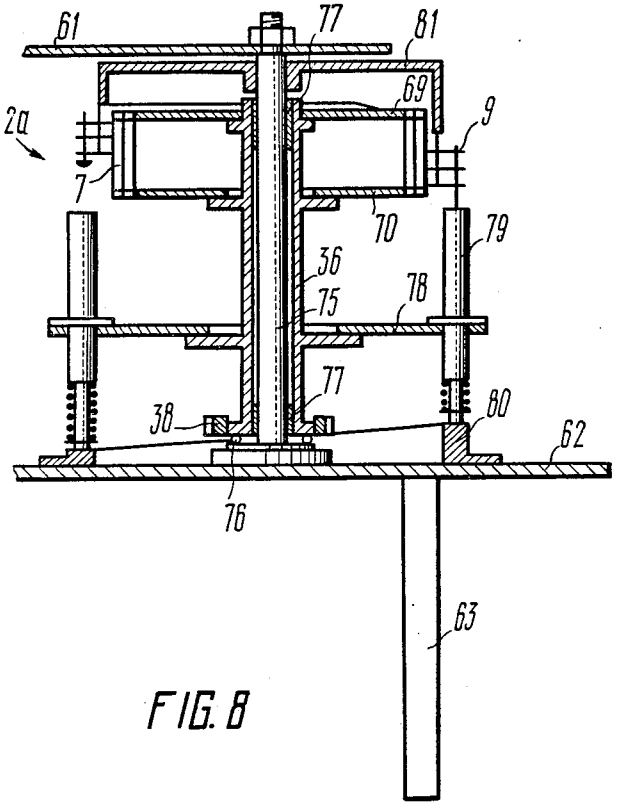
FIG. 8 is a section view taken along line VIII—VIII of FIG. 2.

The discs 69 and 70 (FIG. 8) of the sprocket 2a are secured to lugs on the hollow shaft 36 fitted on a pintle 75 and resting on bearings 76. Provided between the pintle 75 and shaft 36 are bearings 77 which enable the shaft 36 to rotate freely together with the sprocket 2a about the pintle 75 secured to the plates 61 and 62.

On the shaft 36, there are placed the gear 38 and a disc 78. Secured to the latter are actuating mechanisms 79 for shaping base electrodes, the spacing between these mechanisms along the circumference of the disc 78 being equal to the arc between the centres of the clamps 9 with the sprocket being engaged by the chain conveyor 7. Secured to the upper surface of the plate 62 is a former 80 made in the form of a ring with variable height, the top surface whereof interacts with the actuating mechanisms 79. When an actuating mechanism interacts with the higher portion of the former 80, it exerts an action on base electrodes. In this case, the clamps 9 holding bases are lowered into the zone of action of the actuating mechanisms to co-operate therewith. To this end, secured to the plate 61 or a pintle 75 is a former 81 which is in the form of a half-ring having a variable height and disposed where the conveyor 7 engages the sprocket 2a. The former 81 co-operates with the roller 29 (FIG. 4) of the clamp 9, thereby making the slide 20 to travel along the guides 19.

Figure 9:
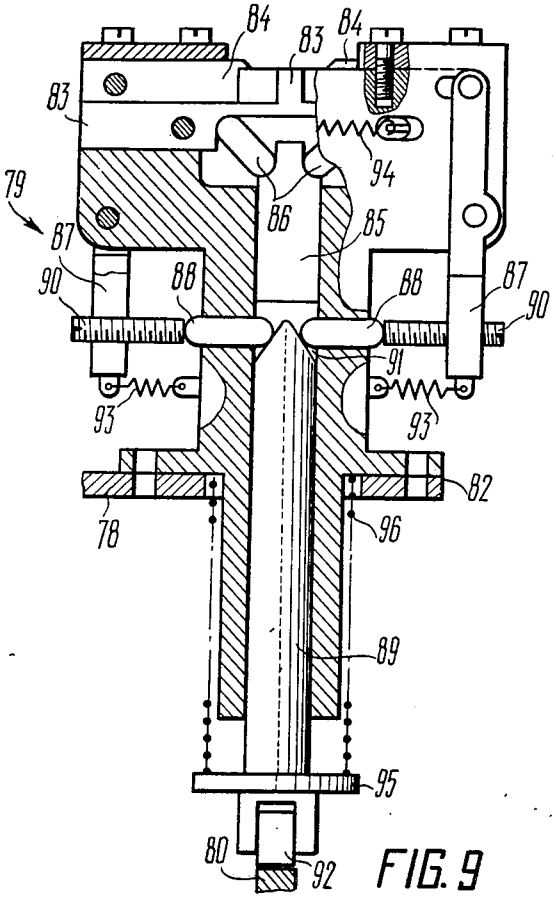
FIG. 9 is a longitudinally cut-away view of an actuating mechanism for shaping base electrodes, according to the invention.

An actuating mechanism 79 comprises a housing 82 (FIG. 9) resting on the disc 78, two male dies 83, two female dies 84, a push rod 85 interacting with two sliding blocks 86, two arms 87 articulated to the female dies 84, and push rods 88 accommodated in the housing 82, each push rod 88 having one of its ends interacting with the tapered surface of a rod 89 and the other end, with an adjusting screw 90.

The rod 89 passes through a hole 91 made in the housing 82 and has, on its free end, a roller 92 contacting the surface of the former 80. The female dies 84 are forced apart by a spring 93 through an arm 87. The male dies 83 are pressed against each other by a spring 94. Inserted between the housing 82 and a shoulder 95 of the rod 89 is a tension spring 96.

The discs 69 and 70 (FIG. 10) of the sprocket 3*a* are fitted on a shaft 97 rotatable in bearings 98 and resting on bearings 99. The shaft 97 supports a disc 100 with actuating mechanisms 101 for flattening base electrode ends being arranged along its circumference so that the spacing between two mechanisms is equal to the arc between the centres of the clamps 9 as the sprocket 3*a* is engaged by the conveyor 7. These actuating mechanisms are actuated by a former 102 made in the form of a ring with variable height and secured to the upper surface of the plate 62.

Secured to the lower surface of the plate 61 is a former 103 in the form of a half-ring, which introduces the clamps 9 holding bases into the zone of action of the actuating mechanisms 101.

Since, with the sprocket 3*a* being engaged by the conveyor 7, the clamps 9 holding bases occupy the space between the discs 69 and 70, to provide for vertical movement of the clamps 9 a through hole is made in the disc 69, accommodating a bushing 104 with a rod 105. One end of the rod 105 interacts with the former 103, while the other end thereof interacts with the roller 29 (FIG. 4) of a clamp 9. A through hole 106 is made in the disc 70 (FIG. 10) for a base to pass therethrough as a respective clamp 9 is being lowered into the zone of action an actuating mechanism 101. A compression spring 107 is received about the rod 105, which is intended to press the rod 105 against the former 103.

Figure 11:
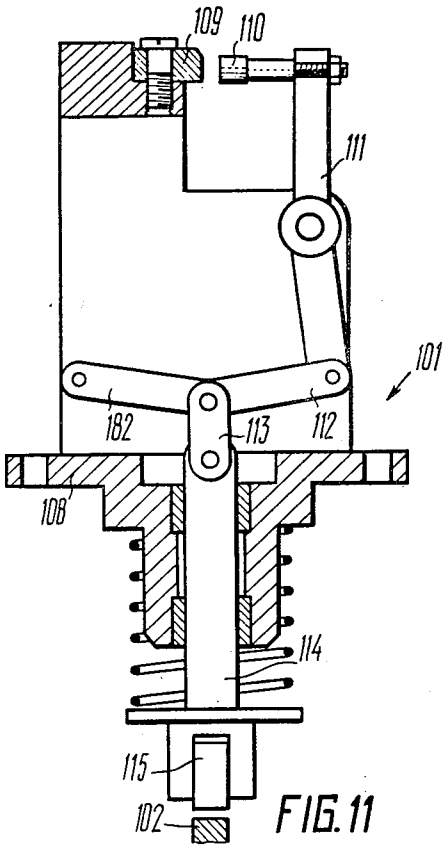
FIG. 11 is a longitudinally cut-away view of an actuating mechanism for flattening electrode ends, according to the invention.

An actuating mechanism 101 (FIG. 11) comprises a housing 108, an anvil 109, and a hammer 110 on an arm 11 articulated to the housing 108 and linked through shackles 112 and 113 to a rod 114 provided with a roller 115 interacting with the former 102. The rod 114 is urged against the former 102 by means of a spring.

Figure 13:
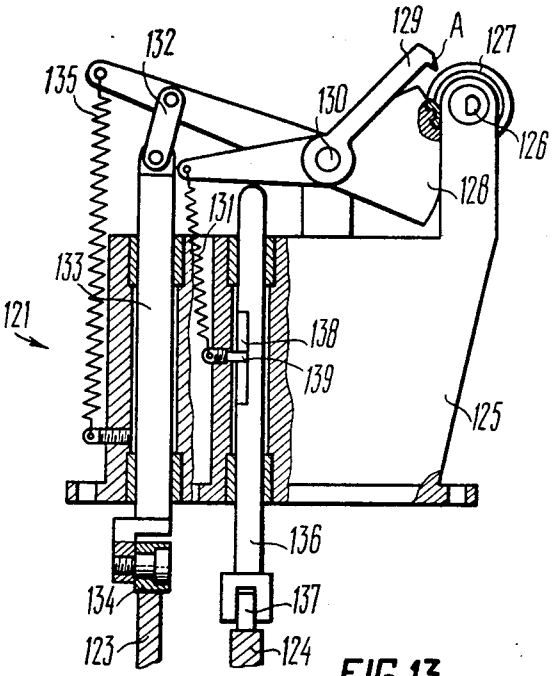
FIG. 13 is a longitudinally cut-away view of an actuating mechanism for bending electrode ends, according to the invention.
Figure 12:
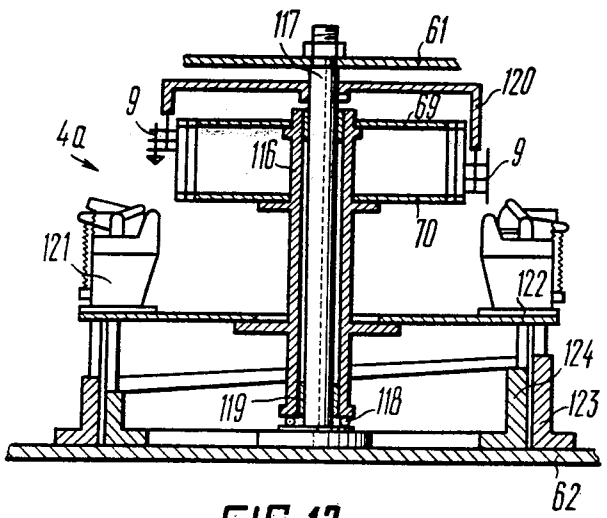
FIG. 12 is a section view taken along line XII—XII of FIG. 2.

The discs 69 and 70 (FIG. 12) of the sprocket 4*a* for bending base electrode ends are fitted on a hollow shaft 116 adjusted on a pintle 117 and resting on bearings 118. Bearings 119 are provided between the shaft 116 and pintle 117. The latter is secured to plates 61 and 62. Secured to the lower surface of the plate 61 or to the pintle 117 is a former 120 made in the form of a half-ring and enabling the clamps 9 holding bases to be lowered into the zone of action of actuating mechanisms 121 for bending base electrode ends. Each mechanisms 121 are arranged on a disc 122 fitted on the shaft 116. Secured to the upper surface of the plate 62 are parallel formers 123 and 124 in the form of concentric rings with variable height, interacting with the actuating mechanisms 121. Each actuating mechanism 121 comprises a housing 125 (FIG. 13) accommodating a male die 126 with a gear 127, a gear quadrant 128 interacting with the gear 127, and a female die 129 fitted on a shaft 130 together with the quadrant 128. The female die 129 has a pointed tip A and is associated with a spring 131 urging it apart from the male die 126. The quadrant 128 is linked through a shackle 132 with a rod 133 travelling in the guide sleeves of the housing 125 and provided, on one of its ends, with a roller 134 rolling over the former 123. The quadrant 128 is associated with the housing 125 through a spring 135.

The female die 129 is brought close to the male die 126 by means of a rod 136, one end whereof interacts with the female die 129 and the other is provided with a roller 137 rolling over the former 124. To preclude rotation of the rod 136, the latter is provided with a slot 138 receiving a screw 139.

Figure 10:
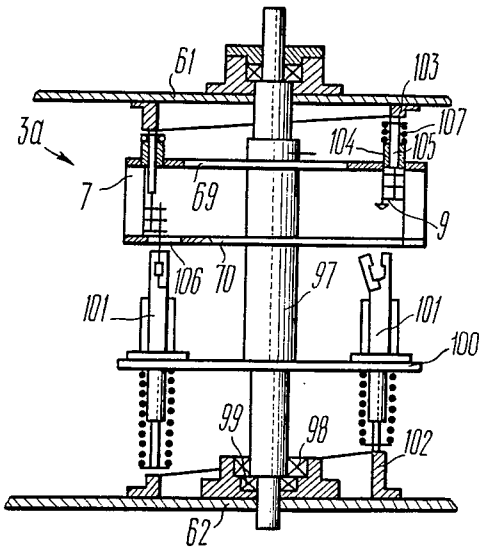
FIG. 10 is a section view taken along line X—X of FIG. 2.
Figure 14:
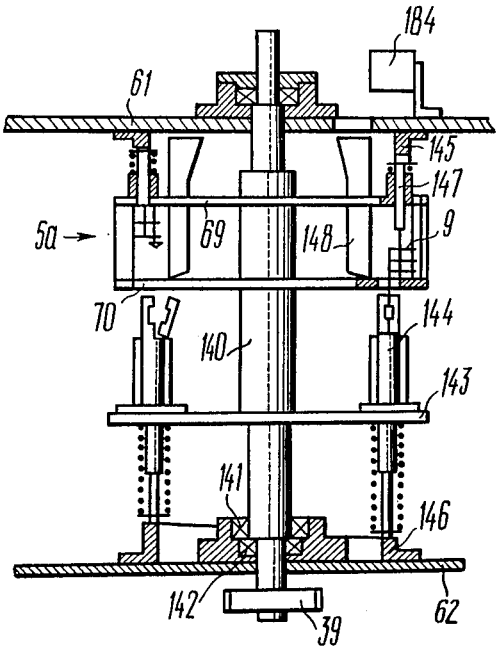
FIG. 14 is a section view taken along line XIV—XIV of FIG. 2.

The discs 69 and 70 (FIG. 14) of the sprocket 5*a* are fitted on a shaft 140 rotating in bearings 141 and resting on bearings 142. The shaft 140 carries the gear 39 and a disc 143 with actuating mechanisms 144 for clamping base electrode ends after placing the cathode thereon being arranged along its circumference so that the spacing between two mechanisms is equal to the arc between the centres of the clamps 9 as the sprocket 5*a* is engaged by the conveyor 7. Secured to the lower surface of the plate 61 is a former 145 enabling respective clamps 9 to be lowered into the zone of action of the actuating mechanisms 144, while secured to the upper surface of the plate 62 is a former 146 actuating the mechanisms 144. Since, with the sprocket 5*a* being engaged by the conveyor 7, the clamps 9 occupy the space between the discs 69 and 70, the clamps 9 are made to enter the zone of action of an actuating mechanism 144 by means of rods 147 interacting with the former 145 just like the rod 105 (FIG. 10) interacts with its respective former, with holes being made in the discs 69 and 70 (FIG. 14) similarly as in the case of the sprockets 3*a* (FIG. 10).

Cathodes are placed on the bent electrode ends in a conventional manner, being fed from a tray 148 mounted on the plate 61.

Figure 15:
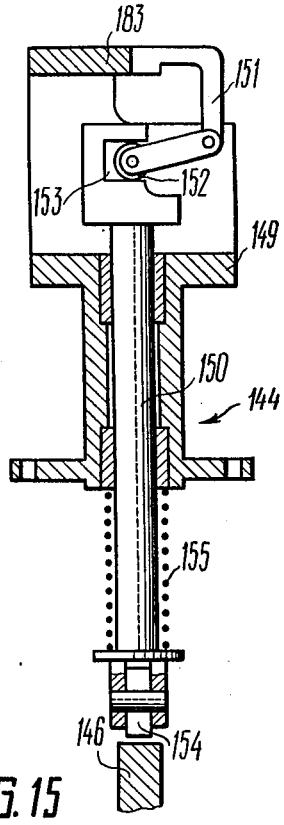
FIG. 15 is a longitudinally cut-away view of an actuating mechanism for clamping the cathode with electrode ends, according to the invention.

An actuating mechanism 144 (FIG. 15) comprises a housing 149 with a rod 150 moving thereinside. One end of the rod 150 is associated with a clamp 151 through a roller 152 received in a slot 153 made in the rod 150. The other end of the rod 150 is provided with a roller 154 interacting with the former 146. The rod 150 is pressed against the former 146 by a spring 155.

Figure 16:
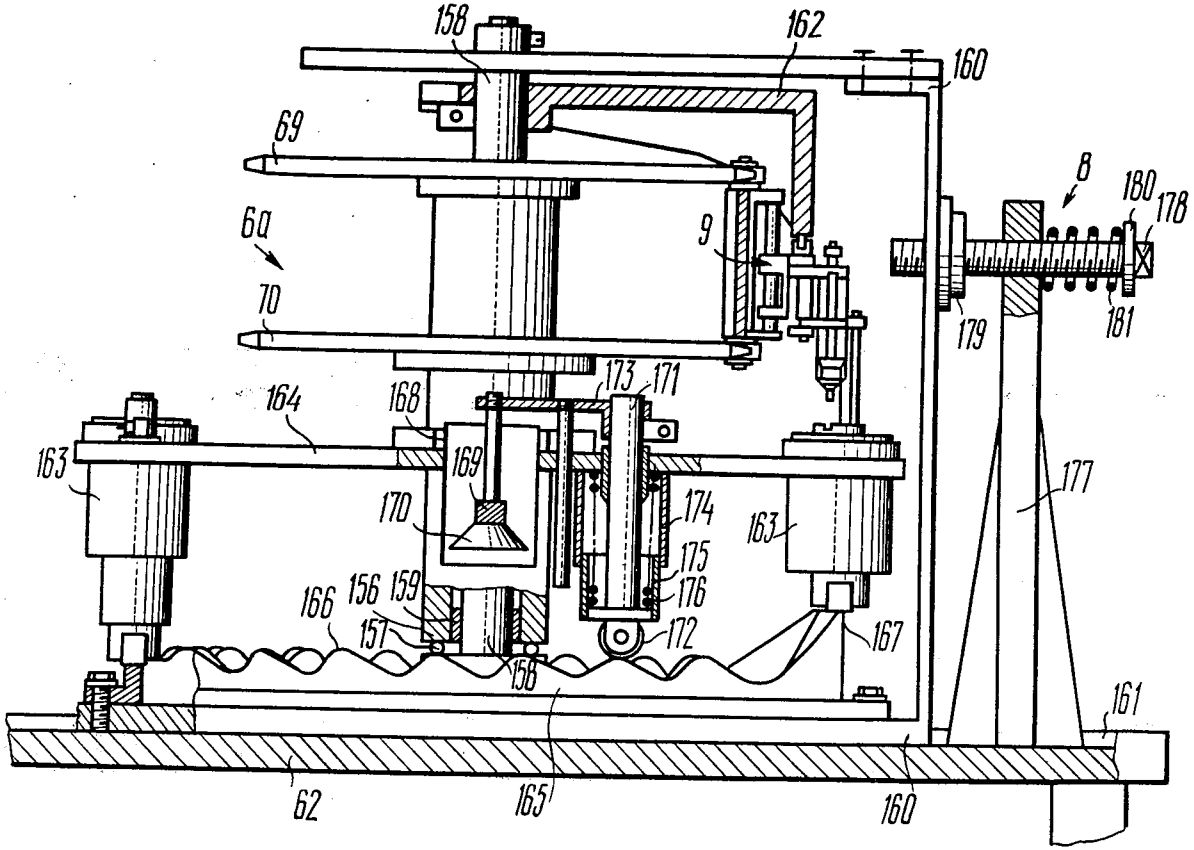
FIG. 16 is a section view taken along line XVI—XVI of FIG. 2.
Figure 17:
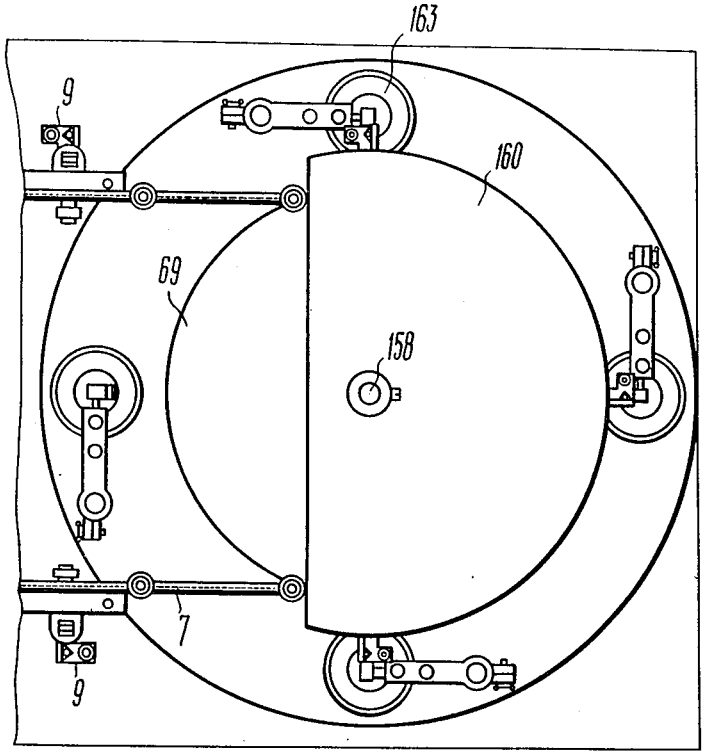
FIG. 17 is a top view of an actuating mechansim for oxidizing cathodes, according to the invention.

The discs 69 and 70 (FIGS. 16 and 17) of the sprocket 6*a* are fitted on a hollow shaft 156 resting on bearings 157 and adjusted on a pintle 158. Bearings 159 are provided between the shaft 156 and pintle 158. The pintle 158 is fitted into a U-frame 160 of the tensioning device 8, which bears up against the plate 62 and is adapted to slide therealong in guide slots 161. Secured to the pintle 158 is a former 162 intended to introduce respective clamps 9 into the zone of action of actuating mechanisms 163 for oxidizing the cathode, each actuating mechanism 163 being provided with means for mixing a suspension and applying it onto the cathode. The mechanisms 163 are arranged along the circumference of a disc 164 so that the spacing between two mechanisms is equal to the arc between the centres of the clamps 9 as the sprocket 6*a* is engaged by the conveyor 7. The disc 164 is fitted on the shaft 156.

Figure 18:
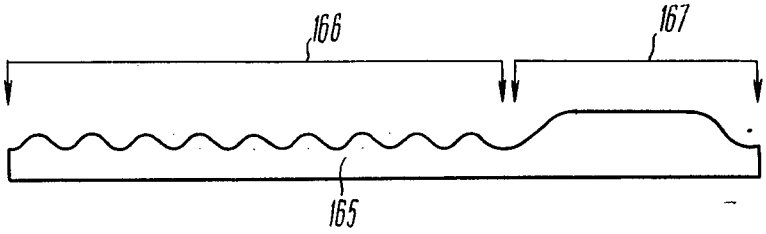
FIG. 18 shows diagramatically the former made in the form of a ring.

Secured to the bottom section of the frame 160 is a former 165 actuating the mechanisms 163. The former 165 is made in the form of a ring whereof the surface contacting with the actuating mechanisms 163 includes a corrugated portion 166 (FIG. 18) and a flat portion 167, the latter being slightly higher than the corrugated portion 166 and the transition from one portion to the other being smooth.

Each actuating mechanism 163 comprises a vessel 168 for the suspension, a spatula 169 for applying the suspension onto the cathode, a mixer 170 disposed on the spatula 169, and a rod 171 with a roller 172 making contact with the surface of the former 165. The rod 171 is associated with the spatula 169 through a bracket 173 and is received in two telescopically arranged guides 174 and 175. The rod 171 is linked with the guide 175. The guide 175 accommodates a spring 176 which moves the guide 175 relative to the guide 174 and presses the roller 172 of the rod 171 against the former 165. In this case, as the roller 172 rolls over the corrugated portion 166 of the former, the rod 171 makes the spatula together with the mixer 170 to oscillate. When the roller 172 starts rolling over the flat portion 167 of the former, the spatula 169 comes out of the vessel 168 and applies the suspension onto the cathode in a conventional manner.

The tensioning device 8 comprises a vertically mounted bracket 177 rigidly secured to the plate 62, a screw 178 passing through a hole made in the bracket 177, and a nut 179 fitted into the frame 160. The screw 178 has a shoulder 180 with a spring 181 received about the screw abutting thereagainst; the other end of the spring 181 abuts against the bracket 177.

To stretch the chain conveyor 7 the screw 178 is driven into the nut 179 with the result that the U-frame 160 together with the sprocket 6a are made to move along the guide slots 161 of the plate 62 towards the bracket 177. As this takes place, the spring 181 is compressed and serves as a shock absorber.

The proposed arrangement for assembling vacuum tube bases operates as follows.

Once the motor 35 (FIG. 6) is switched on, it actuates the driving sprockets 2a and 5a through the V-belt 40, reducer 41 and gears 43, 48, 50, 38 and 42, 45, 47, 39, as well as the conveyors 32 and 33 through the gears 52, 53 and 55 to 58.

The driving sprockets 2a and 5a actuate the chain conveyor 7 which, in turn, actuates the sprockets 1a, 3a, 4a and 6a which from now on, rotate continuously together with the actuating mechanisms associated therewith. The rotation of the sprocket 1a (FIG. 7) in synchronism with the movement of the conveyor 7 makes the stop 31 of the jaw 22 of a respective clamp 9 to interact with the former 66, whereby the jaw in question is forced apart from the jaw 21. As this takes place, a base from the tray 65 (FIG. 7) slips into the thus opened clamp 9 which, as the conveyor 7 advances further, is no more acted upon by the former 66, and the jaws 22 and 21 close clamping the base which remains clamped throughout all the assembling operations to come until it is transferred to the conveyor 32.

As the conveyor 7 approaches the sprocket 2a and engages it (FIG. 8), the roller 29 (FIG. 4) of the clamp 9 rolls over the former 81. Under the action of the latter the slide 20 is lowered towards the guides 19, i.e. the clamp moves across a link of the conveyor 7 so that the electrodes of the base enter the zone of action of the actuating mechanisms 79 (FIG. 8) for forming base electrodes. The actuating mechanisms 79 move in synchronism with the rotation of the sprocket 2a. In this case, the roller 92 (FIG. 9) of the rod 89 of a mechanism 79 moves according to the profile of the former 80 and the rod 89 goes up acting upon the push rods 88 whereby the arms 87 are actuated. The latter bring the female dies 84 together so that they come in contact with the base electrodes which occupy the gap between the female dies 84 as the clamp 9 holding them is lowered. As the rod 89 goes on moving upwards, it actuates the push rod 85 which brings the male dies 83 apart through the sliding blocks 86. As the male dies 83 are coming apart, they bend the electrode ends according to the shape of the female dies 84.

Figure 4:
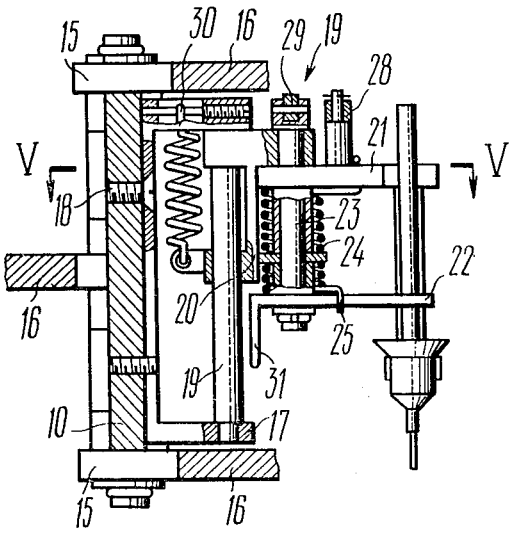
FIG. 4 is a longitudinally cut-away view of a conveyor clamp, according to the invention.

As the roller 92 goes on rolling over the former 80, the rod 89 goes down, and the female dies 84 as well as male dies 83 are brought back to the initial position by means of the springs 94 and 93. After the electrode ends have been bent, which operation is performed while the conveyor 7 moves continuously, the clamps 9 holding bases reassume their initial position aided by the former 81 and spring 30 (FIG. 4).

As the conveyor 7 (FIG. 10) moves further, it encounters the sprocket 3a, engages it and introduces the clamps 9 holding bases into the space between the discs 69 and 70, in which case the rollers 29 of the clamps (FIG. 4) are acted upon by the rod 105 (FIG. 10) which goes down under the action of the former 103 and actuates the slide 20 (FIG. 4) through the guides 19. The clamp 9 (FIG. 10) is lowered and introduces a portion of the base together with the electrodes through the hole 106 in the disc 70 into the zone of action of an actuating mechanism 101 so that the electrodes enter the space between the hammer 110 (FIG. 11) and anvil 109. As the roller 115 of the rod 114 of this actuating mechanism 101 follows the profile of the former, the rod 114 goes up actuating, through the shackles 113 and 112, the arm 111 with the hammer 110 which strikes on the electrodes flattening their ends as required. In this case, the shackles 113 and 112 turn with respect to shackle 182 which is pivotable in the housing.

Then, following the profile of the former 102, the rod 114 returns to the initial position and backs the hammer 110 away from the anvil 109 releasing the electrodes. In this case, the rod 105 returns to the initial position, following the profile of the former 103 (FIG. 10), under the action of the spring 107, while the slide 20 (FIG. 4) of the clamp 9 is forced up by the spring 30 and withdraws the base with electrodes from the hole 106 in the disc 70.

The conveyor 7 moving further engages the sprocket 4a (FIG. 12), the clamps 9 are lowered, similarly as in the case of the sprocket 2a, under the action of the former 120, and the base electrodes enter the zone of action of the actuating mechanisms 121 for bending base electrode ends. The actuating mechanisms 121 move in synchronism with the clamps through that portion of the assembling arrangement where the conveyor 7 engages the sprocket 4a. In this case, the base electrodes occupy the space between the female die 129 (FIG. 13) of a mechanism 121 and the male die 126. The roller 137 of the rod 136 rolls over the former 124 higher and higher until the rod 136 turns the female die 129 which has its pointed tip A brought close to the male die 126 for the base electrodes to be pressed thereagainst.

As the roller 134 of the rod 133 rolls over the former 123, it goes down under the action of the spring 135 and turns, through the rod 133, the gear quadrant 128. The latter interacts with the gear 127 to turn the male die 126. In the course of its movement, the male die 126 bends the electrode ends against the pointed tip of the female die 129. Then, following the profile of the former 124, the rod 136 is urged down by the spring 131 and the female die 129 is separated from the male die 126 releasing the bent ends of the electrodes. At the same time, the quadrant 128 turns under the action of the former 123 actuating the rod 133 and brings the male die 126 to its initial position.

The clamps 9 (FIG. 4) are returned to the initial position by the spring 30, following the profile of the former 120.

As the conveyor 7 engages the sprocket 5a (FIG. 14), the clamps 9 enter the space between its discs 69 and 70. Lowering bases into the zone of action of the actuating mechanisms 144, which is effected by means of the former 145, is similar to that described above in connection with the sprocket 3a (FIG. 10).

In this case, the bent ends of the base electrodes occupy the space between the clamp 151 (FIG. 15) and an anvil 183 accommodated in the housing 149. As this takes place, cathodes are first transferred from a coiling device 184 (FIG. 14) to bins 184 of a widely known structure. From the latter, the cathodes are placed in a conventional manner on the bent electrode ends. At the same time, the roller 154 (FIG. 15) of the rod 150 goes down following the profile of the former 146, under the action of the spring 155, and turns, through the rod 150, the clamp 151. The latter interacts with the anvil 183 to clamp the cathode with the electrode ends.

Then, following the profile of the former 146, the rod 150 goes up and acts upon the clamp 151 so that it moves away from the anvil 183, thereby releasing the base electrodes. Thereafter, the clamps 9 (FIG. 14) reassume their initial position and, as the conveyor 7 advances further, they approach the sprocket 6a (FIG. 16) and, as the roller 29 (FIG. 4) rolls over the former 162 (FIG. 16), are lowered into the zone of action of the actuating mechanisms 163 for oxidizing the cathode.

Each actuating mechanism 163, moving together with the sprocket 6a, is actuated as the roller 172 of the rod 171 co-operates with the former 165, i.e. the rod 171 follows, under the action of the spring 176, the profile of the corrugated portion 166 of the surface of the former 165 (FIG. 18) being thus made to oscillate, which oscillation is transmitted through the bracket 173 to the mixer 170 and spatula 169.

As the roller 172 of the rod 171 starts to roll over the flat portion 167 of the former 165, the rod 171 goes up together with the guide 175 compressing the spring 176 and lifts the spatula 169 through the bracket 173. The spatula with a drop of suspension from the vessel approaches the cathode and wets it. Then, the rod 171 is urged down by the spring 176, following the profile of the former 165. In a similar manner, the suspension is applied to all the cathodes lowered into the zone of action of the actuating mechanisms 163.

At the same time, the clamp 9 goes up following the profile of the former 162 withdrawing the base from the oxidizing zone and the base is delivered by the conveyor 7 for further treatment.

As the conveyor 7 moves further, the clamps 9 together with the bases held therein enter a drying zone B (FIG. 1) with the conveyors 7 and 32 partially participating in the drying process. Used for drying is hot air supplied to the zone B, or conventional heaters installed in the zone B. In the section where the conveyors 7 and 32 run parallel to each other, vacuum tube bases are transferred from the clamps 9 to the clamps 34 of the conveyor 32. In the case, the clamps 34 interact with a former 185 (FIG. 2) to be opened thereby in a conventional manner and clamp the bases held in the clamps 9 of the conveyor 7. Therewith, the clamps 9 are not opened until the roller 28 (FIG. 3) comes in contact with a former 186 (FIG. 2) which forces the jaws 21 and 22 apart. Thus, the bases held in the clamps 34 come out of the zone of action of the conveyor 7 and are transferred to the conveyor 33 in a conventional manner to be delivered for further treatment.

We claim:

1. An arrangement for assembling vacuum tube bases comprising: continuously moving chain conveyor means, rotors each provided with a respective group of actuating means, each of said actuating means performing a different one of assembling operations comprising moving bases into clamps, shaping of electrodes and bases, flattening end bending of electrode ends, clamping cathode with electrode bent ends, oxidixing of cathodes; clamp means attached to links of said chain conveyor means in a cantilevered manner for receiving, holding and transporting bases from one rotor to another; stationary former means each arranged in proximity to a respective group of actuating means to cooperate therewith and to actuate said actuating means for performing respective assembling operations in the process of interaction with bases; chain conveyor means for discharging assembled bases, said rotors being in the form of sprockets formed by two rigidly interlinked toothed discs and disposed intermediate of fixed upper and lower plates, groups of actuating means each performing one of assembling operations arranged on rotors and interacting with clamp means holding bases and arranged on the chain conveyor means both on the outer side and inside of a sprocket through holes in said discs, actuating means for cathode oxidixing and containing a vessel for a suspension, mixer means in the form of a cone, spatula means for applying the suspension onto a cathode, and auxiliary former means for imparting reciprocal movement to said mixer means and said spatula means.

2. An arrangement as claimed in claim 1, wherein said endless chain conveyor means engages all sprockets, at least two of said sprockets being driving sprockets and kinemtically linked with drive means, the remaining sprockets being driven ones, movement being imparted to said driven sprockets from the chain conveyor means actuated into movement by said driving sprockets.

3. An arrangement as claimed in claim 1, wherein said rotors disposed intermediate said fixed plates are biased with respect to one another, the endless chain conveyor means being in form of a zigzag contacting said sprockets both on the outer and inside sides.

4. An arrangement as claimed in claim 1, including through holes in the discs of said sprockets, said clamp means of said conveyor means being disposed therebetween, the holes in a top one of said discs accomodating spring-loaded rods each having one end interacting with a former means, the other end of said rod interacting with clamp means enabling it to be lowered, holes in a bottom one of said discs being a passage therethrough of said bases.

5. An arrangement as claimed in claim 1, wherein said sprockets are disposed intermediate of said fixed plates with said former means interacting with said clamp means disposed on the top plate, said former means interacting with said actuating means disposed on the bottom plate.

6. An arrangement as claimed in claim 1, wherein the actuating means for oxidizing cathodes has vessels for a suspension, mixer means made in the form of cones reciprocating up and down and arranged with a clearance inside said vessels, spatula means for applying said suspension into a cathode, former means having a corrugated portion of reciprocating the mixers for mixing said suspension, and a flat portion to withdraw said spatula means for said vessel when applying said suspension onto a cathode.

* * * * *